US006313614B1

(12) United States Patent
Persson et al.

(10) Patent No.: US 6,313,614 B1
(45) Date of Patent: Nov. 6, 2001

(54) METHOD AND A DEVICE FOR CONTROLLING A SECONDARY VOLTAGE IN A TRANSFORMER DEVICE CONNECTED TO A POWER NETWORK AND COMPRISING AN ON-LOAD TAP-CHANGER

(75) Inventors: Niklas Persson, Sävedalen; Jonas Schenström, Linköping, both of (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/581,307

(22) PCT Filed: Jan. 19, 1999

(86) PCT No.: PCT/SE99/00061

§ 371 Date: Aug. 16, 2000

§ 102(e) Date: Aug. 16, 2000

(87) PCT Pub. No.: WO99/38059

PCT Pub. Date: Jul. 29, 1999

(30) Foreign Application Priority Data

Jan. 21, 1998 (SE) ..... 9800134

(51) Int. Cl.[7] ..... G05F 1/14; G05F 1/153

(52) U.S. Cl. ..... 323/255; 323/257

(58) Field of Search ..... 323/255, 210, 323/213, 256, 260, 211, 258; 363/37, 40, 41, 44, 35, 89, 98

(56) References Cited

U.S. PATENT DOCUMENTS

| | | | | |
|---|---|---|---|---|
| 4,419,619 | * | 12/1983 | Jindrick et al. | 323/257 |
| 4,560,917 | * | 12/1985 | Gyugyi | 323/210 |
| 5,581,173 | | 12/1996 | Yalla et al. . | |
| 5,627,735 | * | 5/1997 | Bjorklund et al. | 363/35 |

* cited by examiner

*Primary Examiner*—Rajnikant B. Patel
(74) *Attorney, Agent, or Firm*—Connolly Bove Lodge & Hutz

(57) ABSTRACT

In a method for controlling a secondary voltage (US) in a transformer device connected to a power network with a given system frequency ($f_1$), which transformer device comprises a tap-changer (TC) which, in dependence on a supplied control signal (RCS), influences the voltage ratio (RAT) of the transformer device, a voltage variable ($u_E$) is formed in dependence on the secondary voltage. The voltage variable comprises at least one first control component ($u_1$, $\phi_1$) which represents a fundamental component of the secondary voltage, and a control quantity (EPV, EEV) is formed in dependence on the voltage variable. The control signal is formed in dependence on a deviation (DPV, DEV) between the control quantity and a given reference value (PVR, EVR) therefor and is supplied to the tap-changer. The actual fundamental frequency ($f_1$*) of the power network is continuously sensed and the voltage variable is formed in dependence thereon.

22 Claims, 7 Drawing Sheets

METHOD AND A DEVICE FOR CONTROLLING A SECONDARY VOLTAGE IN A TRANSFORMER DEVICE CONNECTED TO A POWER NETWORK AND COMPRISING AN ON-LOAD TAP-CHANGER

TECHNICAL FIELD

The present invention relates to a method for controlling a secondary voltage in a transformer device connected to a power network, the transformer device comprising a tap-changer, preferably of static type, which, in dependence on a control signal supplied to it, influences the voltage ratio of the transformer device, and to a device for carrying out the method.

BACKGROUND ART

In electric power networks for transmission and distribution of alternating current, the voltage tends to vary, primarily because of variations in the current in the power network. Power transformers in such power networks are therefore often equipped with a tap-changer, which permits a stepwise switching of the ratio of the transformer under load. To this end, such a transformer has a main winding on each of its primary and secondary sides and, for example, on its primary side at least one and normally two control windings with different numbers of winding turns, each one with two terminals. By connecting these control windings in such a way that the voltage between their respective terminals either contributes to or counteracts the voltage between the terminals of the primary main winding, the transformer ratio may, with a few switching operations, be changed in a plurality of steps of a predetermined magnitude.

The tap-changers are normally controlled by control equipment, which, in dependence on a comparison between a reference value for the voltage at a certain point in the power network and a sensed voltage at this point, forms a control signal for the tap-changer, which is supplied to the tap-changer for ordering switchings of the control windings.

The voltage of the power network comprises, in addition to a component of the fundamental frequency, usually also components of higher frequencies, harmonics, generated, for example, by pieces of equipment connected to the power network. These harmonics do not necessarily have the same phase position as the component of fundamental frequency. Voltage drops in the power network are usually for the most part related to the fundamental tone, since harmonics and other disturbances generally emanate from equipment connected to the power network.

Motors, for example, may be subjected to harmful overheating in the event that the root mean square (rms) value of their supply voltage exceeds a predetermined value, whereas other types of equipment, for example computer equipment, usually are more sensitive to the peak value of the voltage. Since the voltage, in addition to the fundamental component, also contains harmonics, its peak and rms values do not generally correspond in such a way that it is possible to simultaneously maintain both the peak and the rms values separately at the desired values.

The fundamental frequency, usually nominally equal to 50 or 60 Hz, is generally not fixed but varies in dependence on a plurality of factors. In strong power networks with good frequency control, the frequency variations typically amount to ±0.1 Hz whereas in extreme cases they be of the order of magnitude of ±5 Hz.

Up to now, the above-mentioned switching operations in the tap-changer have usually taken place by means of mechanical switching devices, which, among other things, has resulted in the switching time from one tap-changer position to another being relatively long, and hence also the requirements for speed of the control equipment have been relatively low.

US patent document U.S. Pat. No. 4,419,619 discloses a transformer device of the kind described above as well as control equipment for its tap-changer composed around a microprocessor. The secondary voltage is sampled on a number of sampling occasions and the sampled values are supplied to the microprocessor which is adapted, by means of the so-called Discrete Fourier Transform (DFT), to convert the sampled voltage values into a digital signal corresponding to the RMS value over a period of the sensed voltage. A difference of a reference value, also generated in digital form, and the mentioned digital signal corresponding to the RMS value of the sensed voltage is formed and supplied, after conversion into analog form, to a motor-driven switching device with rotating contacts for executing switchings of the control winding of the tap-changer.

The secondary voltage is sampled at 16 sampling occasions for a cycle of the voltage and the data collection, in order to form a mean value, takes place during 32 cycles of the fundamental tone. As reference point for starting the sampling cycle, a zero crossing for the secondary current of the transformer is used. After 32 cycles, the processing of the 16 * 32 sampled values is started, apparently first by the formation of a mean value and then by means of the above-mentioned Fourier transform. The processing results in a determination of a measure of the RMS value of the secondary voltage over a cycle of the fundamental tone.

The Fourier analysis is carried out only for the fundamental component, but it is indicated that the algorithm may be modified to analyze also tones of a higher order, which according to this document would be of particular interest in applications comprising thyristor-switched capacitors.

The algorithm for the discrete Fourier transform may be conceived as a selective filter which, from the sequence of sampled values, determines and forwards values of amplitude and phase angle for a component in the sequence of a predetermined selecting frequency. In the device described in the cited patent document, the selecting frequency is equal to the nominal frequency of the power network, that is, it is assumed that the frequency of the fundamental component is equal to the nominal frequency of the power network.

US patent document U.S. Pat. No. 5,581,173 describes a similar use of a microprocessor, also with 16 samples per cycle of the fundamental tone. In this case, the sampled values are sensed on a half-wave-rectified signal corresponding to the secondary voltage of the transformer device, and therefore half of the sampled values are equal to zero. In the device described in this document, a mean-value formation is performed over 8 periods of the secondary voltage of the transformer device.

SUMMARY OF THE INVENTION

The object of the invention is to obtain an improved method of the kind described in the introductory part of the description, which permits a better accurary in the determination of the control signal of the control equipment, and a device for carrying out the method.

According to the invention, this is achieved by forming a voltage variable in dependence on the secondary voltage of the transformer device, by forming a control quantity in dependence on the voltage variable, and by forming the control signal in dependence on a deviation between the control quantity and a given reference value therefor. The voltage variable comprises at least a first control component which represents a fundamental component of the secondary voltage, and is formed in dependence on the actual fundamental frequency of the power network, which frequency is continuously sensed.

According to an advantageous improvement of the invention, the voltage variable also comprises a second control component which represents a harmonic component of the actual voltage value.

According to another advantageous embodiment of the invention, whereby a consecutive actual-value sequence of discrete actual voltage values are formed in dependence on the secondary voltage, amplitude values and phase-angle values for the control components comprised in the voltage variable are formed by means of a Fourier analysis of the sequence of actual values, whereby, at least for determining the phase-angle value of the first control component of the voltage variable, a recursive method is utilized.

BRIEF DESCRIPTION OF THE DRAWINGS

The invention will be described in greater detail by description of embodiments with reference to the accompanying drawings, which are all schematic and in the form of single-line diagrams and block diagrams, respectively, and wherein.

DESCRIPTION OF THE PREFERRED EMBODIMENTS

Figure 1B:
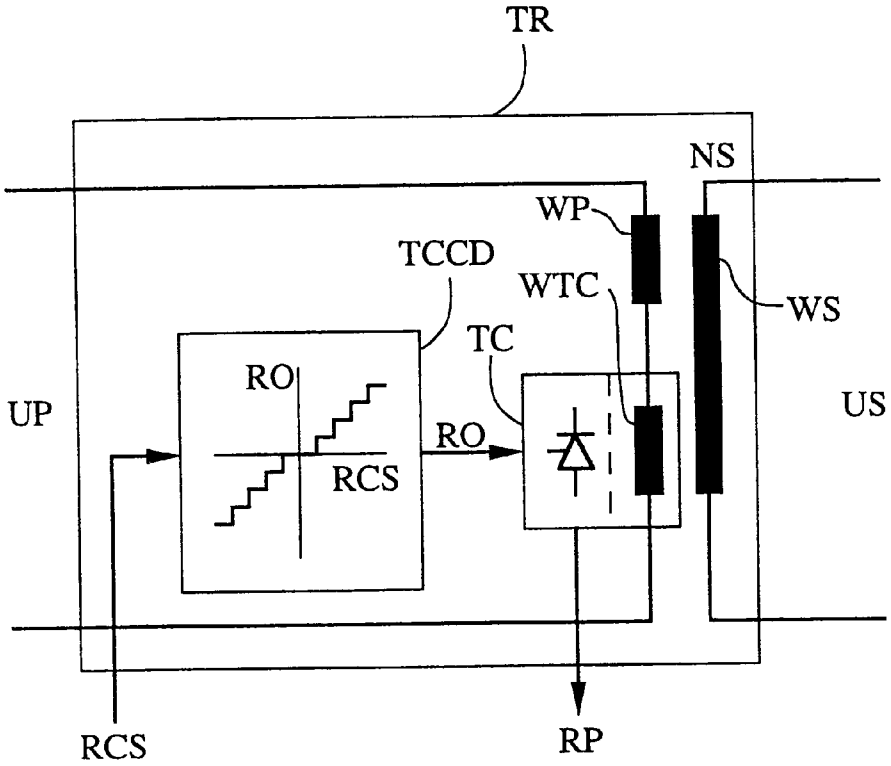
FIG. 1B shows a tap-changer for a transformer device according to FIG. 1A.

The following description relates both to the method and to the device.

The control equipment comprises calculating members, shown in the figures in the form of block diagrams, and it is to be understood that the input and output signals to the respective blocks may consist of signals or calculating values. Signal and calculating value are therefore used synonymously in the following.

In order not to burden the description with distinctions which are self-evident to the person skilled in the art, in certain cases the same designations are used for the voltages and frequencies and other variables which occur in the power network and the transformer device as are used for the measured values and signal/calculating values, corresponding to the first-mentioned variables, which are supplied to and processed in the control equipment described in the following.

The block diagrams show measured values and blocks for forming certain calculating values which are used in other shown blocks; connecting lines between these measured values and these blocks have in certain cases been omitted in order not to burden the drawings, but it is to be understood that the respective calculating values are obtained from the blocks in which they are formed.

Further, it is to be understood that, although the blocks shown in the figures are referred to as units, members, filters, etc., particularly in those cases where their functions are implemented as software in, for example, microprocessors, these are to be understood as means for achieving the desired function.

Concepts, Designations and Introductory Theory

The power network to which the transformer device, which will be described in the following, is connected is assumed to have a nominal system frequency which is designated $f_1$. Usually, $f_1$=50 or 60 Hz. The fundamental frequency of the power network is designated $f_1$*. The nominal value of the fundamental frequency is equal to the value of the system frequency, but its actual value normally deviates from the nominal value. It is further assumed that the secondary voltage US and the primary voltage UP of the transformer device comprises a fundamental component $US_1$, $UP_1$, respectively, of the fundamental frequency, and a number of components, harmonics, of frequencies which are integer multiples $nf_1$* of the fundamental frequency, where n is a natural number, n=1, 2, 3, . . . Each one of these components has a specific amplitude $US_n$, $UP_n$, respectively, and a specific phase angle $\phi_n$ in relation to a reference phase. Generally, the secondary voltage, for example, may be expressed as a sum of these components $$US = \sum_{n=1}^{\infty} US_n \sin(2\pi n f_1^* t + \varphi_n) \tag{1}$$

where t designates the time.

A voltage-measuring device (not shown in the figures) forms, in some manner known per se, a voltage-measurement value representing the secondary voltage of the transformer, which voltage-measurement value in the following is designated u*.

Likewise, it is assumed that the voltage-measurement value may be expressed as a sum of a fundamental component and a number of harmonics $$u^* = \sum_{n=1}^{\infty} u_n^* \sin(2\pi n f_1^* t + \varphi_n) \tag{2}$$

where, however, in practice only a finite number of harmonics are of interest.

In the following, a piece of control equipment will be described which, according to the invention, forms a control signal for the tap-changer position in dependence on the voltage-measurement value. Prior to the actual signal processing, the voltage-measurement value is pre-filtered in pre-filtering unit comprised in the control equipment. This unit comprises means for limiting, in some manner known per se, the amplitude of the voltage-measurement value, typically to 150% of the nominal value of the peak voltage, and the rate of change of the voltage-measurement value, and to forward to the control equipment the voltage-measurement value, thus limited, for further signal processing in the control equipment according to the invention. It is assumed in this connection that the limitation of the rate of change is so chosen that it does not influence the signal processing within the frequency range of practical interest to the control signal. The output signal from the prefiltered unit will be referred to in the following as actual voltage value and be designated u.

Further, it is assumed that the control equipment, although not specifically shown in the figures, in some manner known per se, operates in a sampled manner, that is, with signals and calculating values which are discrete in time. The voltage-measurement value will thus consist of a consecutive actual-value sequence u[k] of discrete actual voltage values u[0], u[1], u[2], u[3], . . . , samples, sampled at discrete points kTs in time, sampling occasions, with a sampling frequency $f_s$=1/Ts. Here, Ts designates the time, the sampling time, between each sampling occasion, and ka running index, k=0, 1, 2, 3, . . .

In the following, certain applications of the Discrete Fourier Transform, known per se, will be described, and therefore first a number of expressions related to this transform will be stated in general form. According to the theory of the transform, from a periodic actual-value sequence u[k] of discrete actual values, the amplitude and phase angle of a component in the actual value sequence with a certain frequency f, in the following referred to as the selecting frequency, may be determined from a sum $$U[f] = \sum_{k=0}^{N-1} u[k] * e^{-j\omega kTs} \tag{3}$$

where ω=2πf is the angular frequency corresponding to the selecting frequency f and N is a number of consecutive values in the actual-value sequence u[k].

Assume that the actual-value sequence u[k] consists of sampled values from a sinusoidal signal $u(t)=u_n * \sin(\omega t=\phi_n)$, where $u_n$, is the peak value of the signal, ω its angular frequency corresponding to the selecting frequency f, and $\phi_n$ its phase angle relative to a reference signal.

The actual value sequence u[k] may then be written as $$u[k]=u_k * \sin(\omega kTs+\phi_k) \tag{4}$$

and the expression (3) will thus have the form $$U[f] = \sum_{k=0}^{N-1} u_k * \sin(\omega kTs + \varphi_k) * e^{-j\omega kTs} \tag{5}$$

The development of the exponential term in real and imaginary components, provided that N is so chosen that a summation of the expression sin(2ωkTs) takes place over one or more complete cycles of the function sin(2ωwkTs), gives $$U[f] = \sum_{k=0}^{N-1} u_k * (\sin\varphi_k \cos^2(\omega kTs) - j\cos\varphi \sin^2(\omega kTs)) \tag{6}$$

The development of the quadratic trigonometric expressions, still provided that N is so chosen that a summation of the expression sin(2ωkTs) takes place over one or more complete cycles of the function sin(2ωkTs), gives $$U[f]=u_k*N/2*(\sin \phi_k - j \cos \phi_k) \tag{7}$$

Thus, from this the amplitude $u_k$ and the phase angle $\phi_k$ for the signal u(t) may be determined as $$u_k = \frac{2}{N}|U[f]| \tag{8}$$

$$\varphi_k = \text{arctg}\left\{\frac{\text{Re}(U[f])}{-\text{Im}(U[f])}\right\} \tag{9}$$

where || designates the absolute value of and Re( ) and Im( ) the real and imaginary parts, respectively, of U[f].

When forming the phase angle $\phi_k$ the signs for the real and imaginary parts are taken into consideration, in a manner known per se, such that the arc tangent function forms the phase angle within the correct quadrant.

In the following, there will be described how, in an advantageous embodiment of the invention, the discrete Fourier transform is calcualted by a recursive method. In this context, the fact is utilized that, when calculating the sum according to expression (3) on two consecutive sampling occasions, the two sums will substantially contain the same terms. For the recursive calculation of the transform, an expression of the following form is utilized:

$$U_k[f]=U_{k-1}[f]-u[k-N]*e^{-j\omega(k-N)Ts}+u[k]*e^{-j\omega kTs} \tag{10}$$

$U_k$[f] here designates the sum which, according to the expression (3), has been determined from the last N consecutive values in the actual value sequence u[k], and $U_{k-1}$[f] designates the sum which, according to expression (3), has been determined from those N consecutive values in the actual-value sequence u[k] which are displaced one sampling occasion earlier than the values which are used for determining the sum $U_k$[f].

With, for example, N=20, a sum $U_{19}$[f] s calculated from the actual value sequence u[k] according to expression (3) above with values of k corresponding to k=0, 1, 2, . . . , 19 as $$U_{19}[f] = \sum_{k=0}^{19} u[k] * e^{-j\omega kTs} \tag{11}$$

On the sampling occasion corresponding to k=20 in the actual-value sequence u[k], a sum $U_{20}$[f] is calculated from the actual value sequence u[k] according to expression (3) above with values of k corresponding to k=1, 2, 3, . . . , 20 as $$U_{20}[f] = \sum_{k=1}^{20} u[k] * e^{-j\omega kTs} \tag{12}$$

where thus the running index k in expression (12) runs from k=1, 2, . . . , 20, that is, is increased by ONE compared with the calculation in expression (11).

It is realized that 19 of the 20 terms included in $U_{20}$[f] are also included in $U_{19}$[f] and that thus in particular $$U_{20}[f]=U_{19}[f]-u[0]*e^{-j\omega(0)Ts}+u[20]*e^{-j\omega(20)Ts} \tag{13}$$

The sum $U_k$[f] according to expression (10) is thus calculated continuously on each sampling occasion.

The above-mentioned algorithms for determining amplitude and phase angle are preferably calculated by means of an appropriately programmed microprocessor.

The algorithm for the Fourier transform may be conceived as a selective filter, in the following referred to as a Fourier filter, which selects and forwards values of amplitude and of phase angle for a component of the actual-value sequence u[k] of a chosen selecting frequency f. In this connection, thus, the expression Fourier filter relates to a calculating algorithm. The parameters of the filter are determined in a manner known per se. The sampling frequency is chosen in relation to the highest frequency which is to be selected. The number of samples N during the period is chosen according to the expression $$N = \frac{p}{2fTs} \tag{14}$$

where f is the selecting frequency and p a natural number, p=1, 2, 3, 4, . . .

The blocking frequencies $f_b$ of the filter and its settling time $\tau$ after a change of amplitude in its input signal are determined by the parameter p, and are given by the expressions $$f_b = f\left(1 \pm \frac{2k}{p}\right) \tag{15}$$

where k is a natural, k=1, 2, 3, . . . , and $$\tau = \frac{p}{2f} \tag{16}$$

For practical purposes, only those blocking frequencies resulting from the expression (15), which are greater than zero, are taken into consideration.

In the following, the term half-cycle Fourier filter, generally designated FFHC, relates to a Fourier filter which forms as output signal a sum $U_h[f]$ based on expression (3). The sum is formed from an actual-value sequence u[k] consisting of consecutive actual voltage values sampled during a period of time which extends back half a cycle of the fundamental component, that is, at 50 Hz during the last 10 ms (at 60 Hz during the last 8.3 ms).

The term complete-cycle Fourier filter, generally designated FFCC, in the following relates to a Fourier filter which forms as output signal a sum $U_c[f]$ based on expression (3) or advantageously on expression (10) above.

The sum $U_c[f]$ is formed from the actual-value sequence u[k] sampled during a period of time which extends back a full cycle of the fundamental component, that is, at 50 Hz during the last 20 ms (at 60 Hz during the last 16.7 ms).

In the embodiments of the invention described in the following, Fourier filters of this kind may advantageously be adapted to continuously determine the sum $U_h[f]$ and the sum $U_c[f]$, respectively, on each of the sampling occasions, whereby the last N samples are continuously used when calculating the sum.

The determination of the values of amplitude and phase angle for the respective components, based on expressions (8) and (9), may therefore also be advantageously formed continuously on each one of the sampling occasions.

DESCRIPTION OF EMBODIMENTS OF THE INVENTION

Figure 1A:
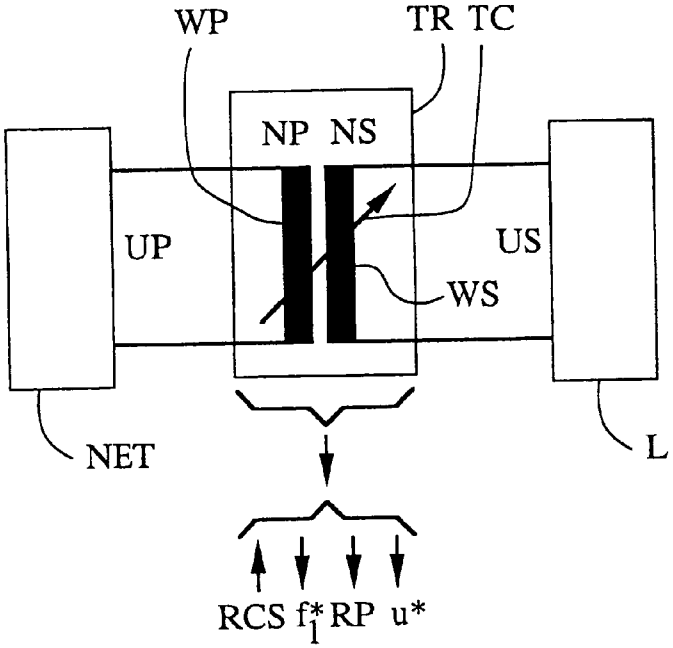
FIG. 1A shows a transformer device with a tap-changer, connected between a power network and a load.

FIG. 1A shows one phase of the transformer device TR with a primary winding WP and a secondary winding WS, the primary winding having N1 turns and the secondary winding having N2 turns. The transformer device comprises a tap-changer TC, marked with an arrow in the figure. The tap-changer has a control range which changes the ratio RAT of the transformer device within an interval $R_{min}$ to $R_{max}$ in a number of steps, each of which corresponds to a change of the ratio of transformation $R_{ink}$. The transformer device, in the following abbreviated the transformer, is connected via the primary winding to a power network NET with the voltage UP and with a system frequency $f_l$, usually equal to 50 or 60 Hz. The secondary winding of the transformer is connected to a load L. The voltage across the secondary winding is designated US and the ratio of the transformer (N2/N1)*R is designated RAT.

FIG. 1B schematically illustrates a tap-changer TC, which, as mentioned in the introductory part, comprises two control windings with different numbers of winding turns, which in the figure are schematically illustrated by a winding symbol WTC, connected in series with the primary winding of the transformer. The tap-changer is of a so-called static typ, that is, swichings of the control windings occur with the aid of static semiconductor elements, for example thyristors. This is schematically marked in the figure by a thyristor symbol.

In the following, it is assumed that the tap-changer is designed such that switching from one tap-changer position to another may only take place in connection with a zero crossing of the current through the control windings of the tap-changer, that is, on average once every half electrical cycle corresponding to once every 10 ms at 50 Hz system frequency (8.3 ms at 60 Hz system frequency). The tap-changer position is controlled in dependence on a position order RO, formed in a position generator TCCD in dependence on a control signal RCS supplied to the position generator. In some manner known per se, the tap-changer forms a position signal RP indicating the actual tap-changer position.

As schematically indicated in FIGS. 1A and 1B, there are sensed at the transformer, in some manner known per se, a voltage, in this embodiment the secondary voltage US, the relevant tap-changer position and the actual value $f_1$* of the fundamental frequency, and there are formed, in some manner not shown in the figures, corresponding signals u*, RP and $f_1$*, respectively, constituting the above-mentioned voltage measurement value and actual values, respectively, for the tap-changer position and the actual fundamental frequency. These signals are supplied to control equipment TCC which, in dependence thereon, in a manner which will be described in more detail below, forms the control signal RCS.

Figure 2:
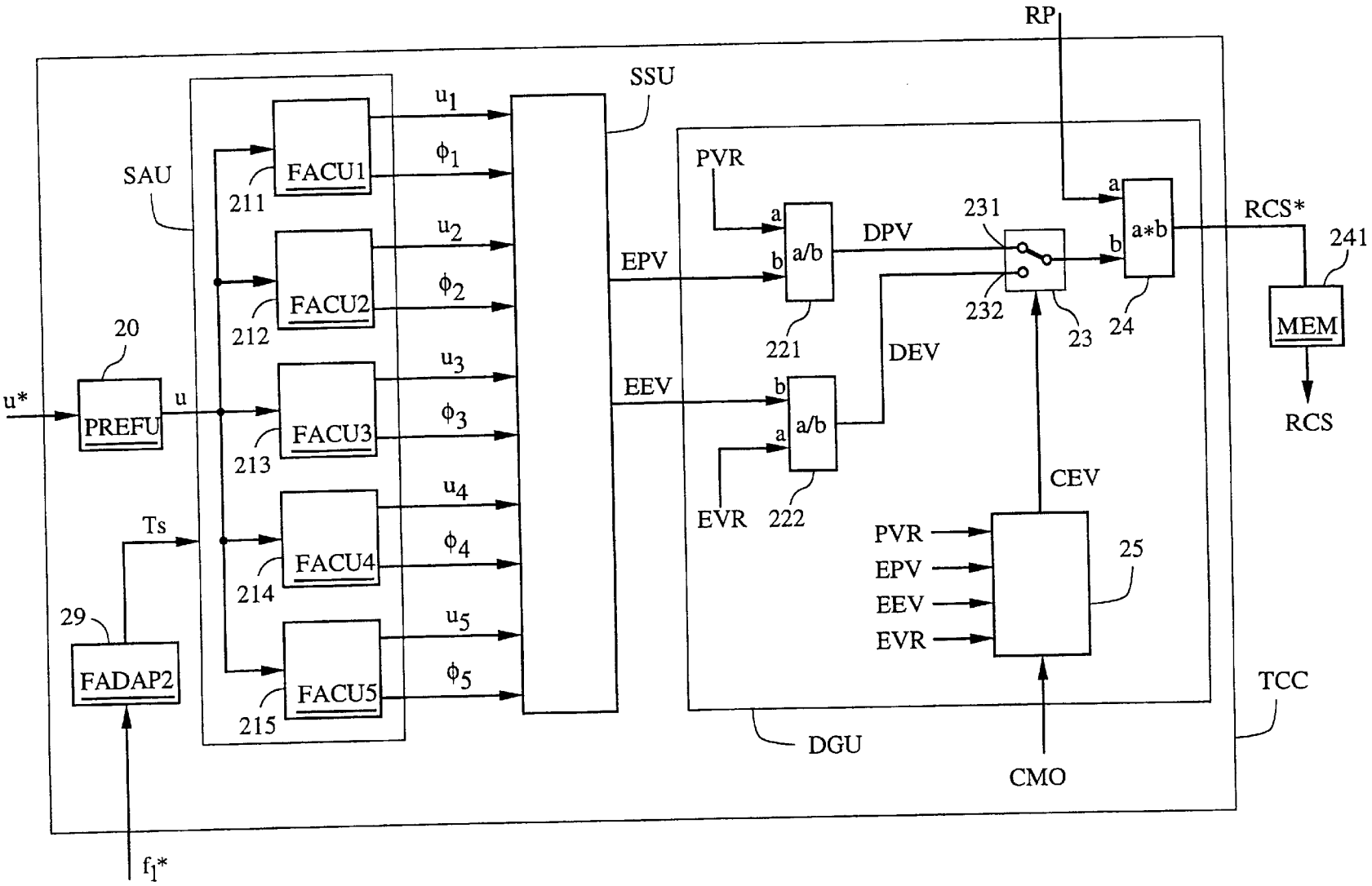
FIG. 2 shows control equipment according to the invention for a tap-changer according to FIGS. 1A–1B.

Such control equipment according to the invention is illustrated in FIG. 2. The control equipment comprises the above-mentioned prefiltering unit 20, which is supplied with the voltage measurement value u* of the sensed secondary voltage, a signal-analyzing unit SAU, a signal-synthetizing unit SSU and a deviation-forming unit DGU, which is supplied with the actual value RP of the tap-changer position.

The prefiltering unit forwards to the signal-analyzing unit the voltage measurement value, limited in the manner described above, as an actual voltage value u, which, as assumed above, constitutes a consecutive actual value sequence u[k] of discrete actual voltage values, sampled at discrete points in time kTs. The signal-analyzing unit comprises a frequency-analyzing sub-unit 211 and, in this embodiment, in addition, four frequency-analyzing sub-units 212, 213, 214 and 215, respectively, which are all supplied with the actual voltage value.

The frequency-analyzing sub-unit 211 is adapted to form, in dependence on the actual voltage value, by means of a Fourier filter an amplitude value $u_1$ and a phase-angle value $\phi_1$ for a first control component, representing a fundamental component of the actual voltage value. The control component corresponds to a component of the actual voltage value, the frequency of which is the selecting frequency f which is used during the calculation based on the expression (3). It is realized that the amplitude value and the phase-angle value which, in this way, are formed of the sub-unit 211 also constitute a measure of amplitude and phase angle of the fundamental component in the secondary voltage of the transformer such that the first control component also represents the fundamental component of this secondary voltage.

In similar manner, the frequency-analyzing sub-unit 212 is adapted to form, in dependence on the actual voltage value, by means of a Fourier filter an amplitude value $u_2$ and a phase-angle value $\phi_2$ for a second control component, representing a component of the actual voltage value with a frequency equal to twice the fundamental frequency. The second control component corresponds to a component of the actual voltage value, the frequency of which is likewise determined by the frequency which is used during the calculation based on expression (3), and for the sub-unit 212 a selecting frequency is chosen which is double the selecting frequency which is chosen for the sub-unit 211. It is also realized that the amplitude value and the phase-angle value which in this way are formed by the sub-unit 212 also constitute measures of amplitude and phase angle of a component of double the fundamental frequency in the secondary voltage of the transformer such that the second control component also represents a component of double the fundamental frequency in this secondary voltage.

The frequency-analyzing sub-units 213, 214 and 215 are in similar manner adapted to form, in dependence on the actual voltage value, by means of Fourier filters, amplitude values $u_3$, $u_4$ and $u_5$, respectively, and phase-angle values $\phi_3$, $\phi_4$ and $\phi_5$, respectively, for control components, representing components of the actual voltage value, and hence of the secondary voltage, with frequencies equal to, respectively, three, four and five times of the fundamental frequency.

Each one of the pairs of amplitude value and phase-angle value, formed by the frequency-analyzing units, defines a sinusoidal signal of a frequency equal to the selecting frequency which is used during the calculation based on expression (3). All the values of the amplitudes and phase angles of the respective control components are supplied to the signal-synthetizing unit SSU, which is adapted to form therefrom a voltage variable $u_E$ by phase-correct addition of all the sinusoidal signals defined in this way. In this embodiment, thus, the voltage variable, expressed in discrete form, is $$u_E = \sum_{n=1}^{5} u_n \sin(n\omega kTs + \varphi_n),$$

where $\omega=2\pi f$ and f is the selecting frequency which is used in the Fourier filter in sub-unit 211.

On each sampling occasion, there is formed, in some manner known per se, the absolute value of values of the voltage variable for each of the discrete times kTs which correspond to k=0, 1, 2, 3, . . . , $2\pi/\omega Ts$, whereupon a peak-value signal EPV is formed as the maximum value of these absolute values of the voltage variable, that is $$EPV = \max\left\{\left| u_E = \sum_{n=1}^{5} u_n \sin(n\omega kTs + \varphi_n) \right|_{k=0,1,2,3,\ldots,2\pi/\omega Ts}\right\}.$$

This peak-value signal constitutes a first control quantity for the control equipment, and during this calculation of the control quantity EPV, all the components in the secondary voltage, the frequencies of which are equal to the fundamental frequency, and integer multiples lower than or equal to five (corresponding to $n \leqq 5$ in expression (2)) of this frequency, are thus taken into consideration, whereas the components, the frequencies of which are integer multiples higher than five (corresponding to n>5 in expression (2)) of the fundamental frequency are eliminated.

Figure 7:
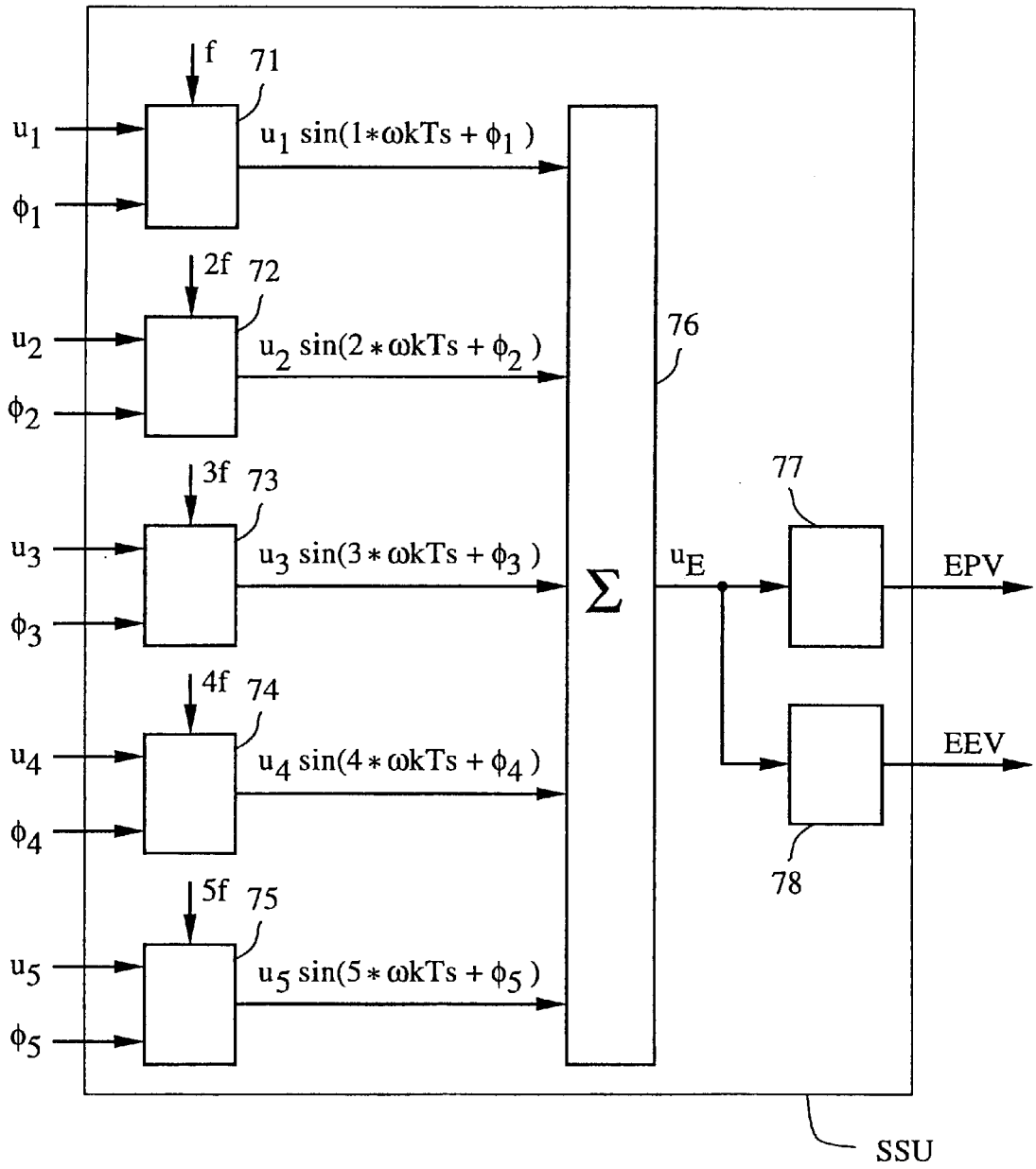
FIG. 7 shows an embodiment of a signal-synthetizing unit in control equipment according to FIG. 2.

One embodiment of the signal-synthetizing unit is illustrated schematically in FIG. 7. That pair $u_1$, $\phi_1$ of amplitude value and phase-angle value, which is formed by the frequency-analyzing unit 211, is supplied, together with a value of the selecting frequency f of the unit, to a calculating unit 71, which forms therefrom a sinusoidal signal of a frequency equal to the selecting frequency and with an amplitude and a phase angle corresponding to the pair $u_1$, $\phi_1$ of amplitude value and phase-angle value. The pairs $u_2$, $\phi_2$ . . . $u_5$, $\phi_5$ of amplitude values and phase-angle values formed by the other frequency-analyzing units 212 . . . 215 are supplied in analogous manner, together with values of the selecting frequencies 2f . . . 5f of the respective unit, to calculating units 72 . . . 75, which form therefrom sinusoidal signals of frequencies equal to the respective selecting frequencies and with amplitudes and phase angles corresponding to the respective pairs of the pairs $u_2$, $\phi_2$ . . . $u_5$, $\phi_5$ of amplitude values and phase-angle values. All the sinusoidal signals are supplied to a summing member 76, which forms therefrom the voltage variable $$u_E = \sum_{n=1}^{5} u_n \sin(n\omega kTs + \varphi_n).$$

The voltage variable is supplied to a calculating member 77, which forms therefrom the peak-value signal EPV according to the above-mentioned expression.

The peak-value signal EPV is supplied to a quotient generator 221 which is comprised in the deviation-forming unit DGU and which forms as output signal the quotient DPV of a reference value PVR for the peak value of the secondary voltage and the peak-value signal EPV, which quotient is supplied, via a first input 231 of a selector member 23, to a multiplier 24. The multiplier forms an output signal RCS* as the product of the quotient DPV and the position signal RP, indicating the current tap-changer position, which output signal is supplied to a memory member 241. The memory member continuously stores the latest value of the output signal from the multiplier and forms, as output signal, the control signal RCS.

When calculating the voltage variable $$u_E = \sum_{n=1}^{5} u_n \sin(n\omega kTs + \varphi_n)$$

it is advantageous, with respect to the need of calculating capacity, to develop, with the aid of known trigonometric relationships, the terms corresponding to n=2–5 such that $u_E$ is expressed in a sum of sinusoidal and cosine terms of the frequency corresponding to n=1. The calculation of the voltage variable, which is not described in detail here, can then be made by forming, from the pairs $u_1$, $\phi_1$, . . . $u_5$, $\phi_5$ of amplitude values and phase-angle values formed by the frequency-analyzing units 211 . . . 215, eleven constants, whereupon the voltage variable is formed as a function of these eleven constants and of the functions sin(ωkTs) and cos((ωkTs).

Frequency Adaptation.

According to known technique, for the frequency-analyzing sub-unit 211, a selecting frequency equal to the nominal system frequency of the power network is chosen and the number of samples during one cycle of an oscillation of the nominal system frequency is chosen as an integer.

As mentioned above, the fundamental frequency of the power network generally deviates from the system frequency, and it is realized from the above that, therefore, the pairs of amplitude values and phase-angle values, formed by the respective frequency-analyzing sub-units according to known technique, do not in principle represent amplitude and phase-angle values for the fundamental component, and multiples thereof, respectively, of the secondary voltage of the transformer.

According to the invention, the actual value $f_1^*=f_1\pm\Delta f_1$ of the fundamental frequency is taken into consideration when designing the control equipment by an automatic adaptation of the function thereof in dependence on a measured value of the fundamental frequency which is sensed in some way known per se. This is achieved according to the invention by continuously modifying parameters in the control equipment, which influence the determination of those pairs of amplitude values and phase-angle values which are formed by the respective frequency-analyzing sub-units, in dependence on the sensed value $f_1^*$ of the actual fundamental frequency of the power network. With knowledge of the frequency variations occurring in the power network, this frequency adaptation may be designed in different ways.

Advantageous embodiments of the invention will be described in the following with reference to FIG. 2 and in more detailed descriptions of embodiments of the frequency-analyzing sub-units 211 and 212.

The frequency-analyzing sub-unit 211.

Figure 3:
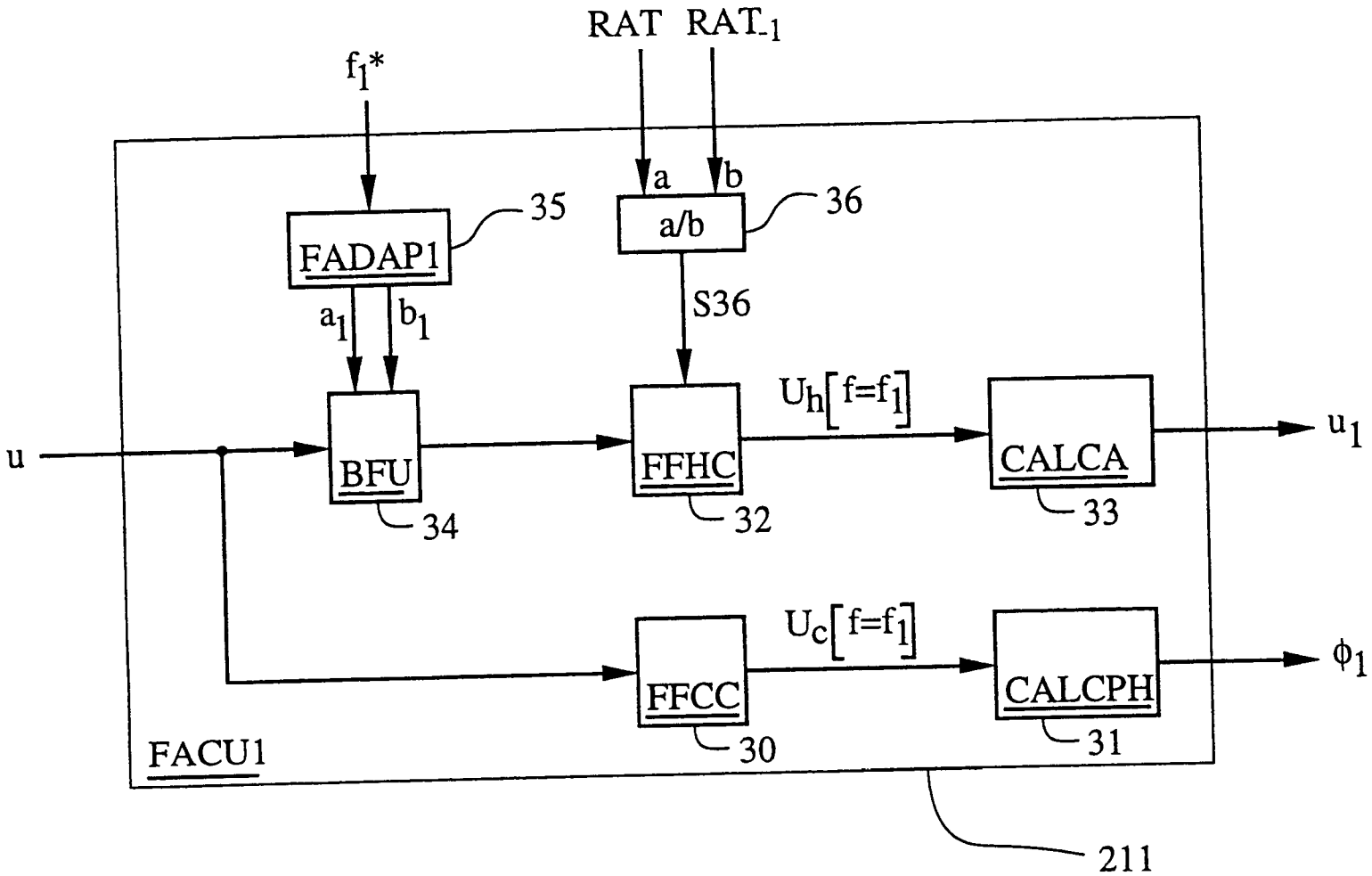
FIG. 3 shows an embodiment of a frequency-analyzing sub-unit in control equipment according to FIG. 2.

An advantageous embodiment of the frequency-analyzing sub-unit 211 is illustrated in FIG. 3. For determining the phase angle $\phi_1$, the actual-value sequence u[k] is supplied to a complete-cycle Fourier filter 30 of the kind described above, which forms as output signal a sum $U_c[f=f_1]$ according to expression (10) for a selecting frequency equal to the system frequency. This sum is supplied to a calculating unit 31, which forms therefrom, as output signal, the phase angle $\phi 1_1$ from expression (9).

As mentioned above, a static tap-changer permits a possibility of changing the tap-changer position on average once every half-cycle of the fundamental frequency, and for utilizing this possibility particularly for the fundamental frequency which is predominant in the secondary voltage, the amplitude, is determined by means of a half-cycle Fourier filter 32 of the kind described above, which forms as output signal a sum $U_h[f=f_1]$ based on expression (3) for a selecting frequency equal to the system frequency.

It should be noted that voltage variations in the power network supplying the transformer device are usually associated with the fundamental component (the other components are generally generated by equipment and installations connected to the power network), and it is important, also for this reason, to rapidly obtain information about amplitude changes in the fundamental component.

The sum $U_h[f]$ is supplied to a calculating unit 33, which forms therefrom, as output signal, the amplitude $u_1$, from expression (8).

In case of otherwise advantageous choices of parameters for the Fourier filtret 32, for example the sampling time $T_s$=0. 001 s, p=1, and the number of samples N=10, which with expression (16) gives a settling time τ=10 ms, the Fourier filter will not block even multiples of the selecting frequency. It is therefore advantageous to eliminate, from the actual-value sequence u[k] which is supplied to the sub-unit 211, at least the lowest even multiples 2f, 4f, 6f, . . . of the selecting frequency before the sequence is supplied to the Fourier filter 32. This is achieved by arranging a band stop filter 34 before the Fourier filter, which band stop filter in this embodiment comprises second-order filters of a so-called Butterworth type with stop frequencies for 100 Hz, 200 Hz, 300 Hz and 400 Hz (at 50 Hz system frequency) as well as a first-order low-pass filter of Butterworth type with the cutoff frequency 325 Hz. The band width for the band stop filters may, for example, be chosen to be 5, 10, 15 and 20 Hz, respectively, whereby the settling time for the combination of band stop filters and Fourier filters is influenced only to a marginal extent.

Frequency Adaptation—Embodiment 1

In a power network where the frequency variations normally lie within a tolerance band of ±1 Hz, the stop frequencies for the second-order filters which are comprised in the band stop filter BFU described above may, in an advantageous embodiment, be adapted in dependence on the actual fundamental frequency of the power network.

Generally, for a second-order filter with a sequence u/k] as input signal and an output signal y[k], the following applies:

$$y[k]=b_0*u[k]+b_1*u[k-1]+b_2*u[k-2]-a_1*y[k-1]-a_2*y[k-2]$$

where $b_0$, $b_1$, $b_2$, $a_1$, $a_2$ are constants.

It is known, by choosing $b_0=b_2$, to achieve a band stop filter, the band width of which is determined by the frequency-independent constants $b_0$, $b_2$, $a_2$. Between the stop frequency and each of the constants $b_1$, $a_1$ there is a relationship which for practical purposes is linear, such that $a_1=K_1f_1^*$ and $b_1=K_2f_1^*$, where $K_1$, $K_2$ are constants and $f_1^*$ is, for example, the actual value of the fundamental frequency. Values of the constants $b_1$, $a_1$ for a number of frequencies may thus, in some manner known per se, be precalculated for the band stop filter in question and be stored in a table. By continuously sensing the actual value of the fundamental frequency, the stop frequency of the band stop filter may be continuously adapted to the actual value of the fundamental frequency, for example by interpolation in the above-mentioned table. This adaptation is illustrated schematically in FIG. 3 by a block 35, comprising means for storing the above-mentioned table. The block is supplied with the actual value $f_1^*$ of the fundamental frequency and forms, in dependence thereon, values of the characterizing constants $b_1$, $a_1$ of the band stop filter 34 which correspond to the above-mentioned frequency value, and transfers these values of the constants to the filter 34.

The Frequency-Analyzing Sub-unit 212

Figure 4:
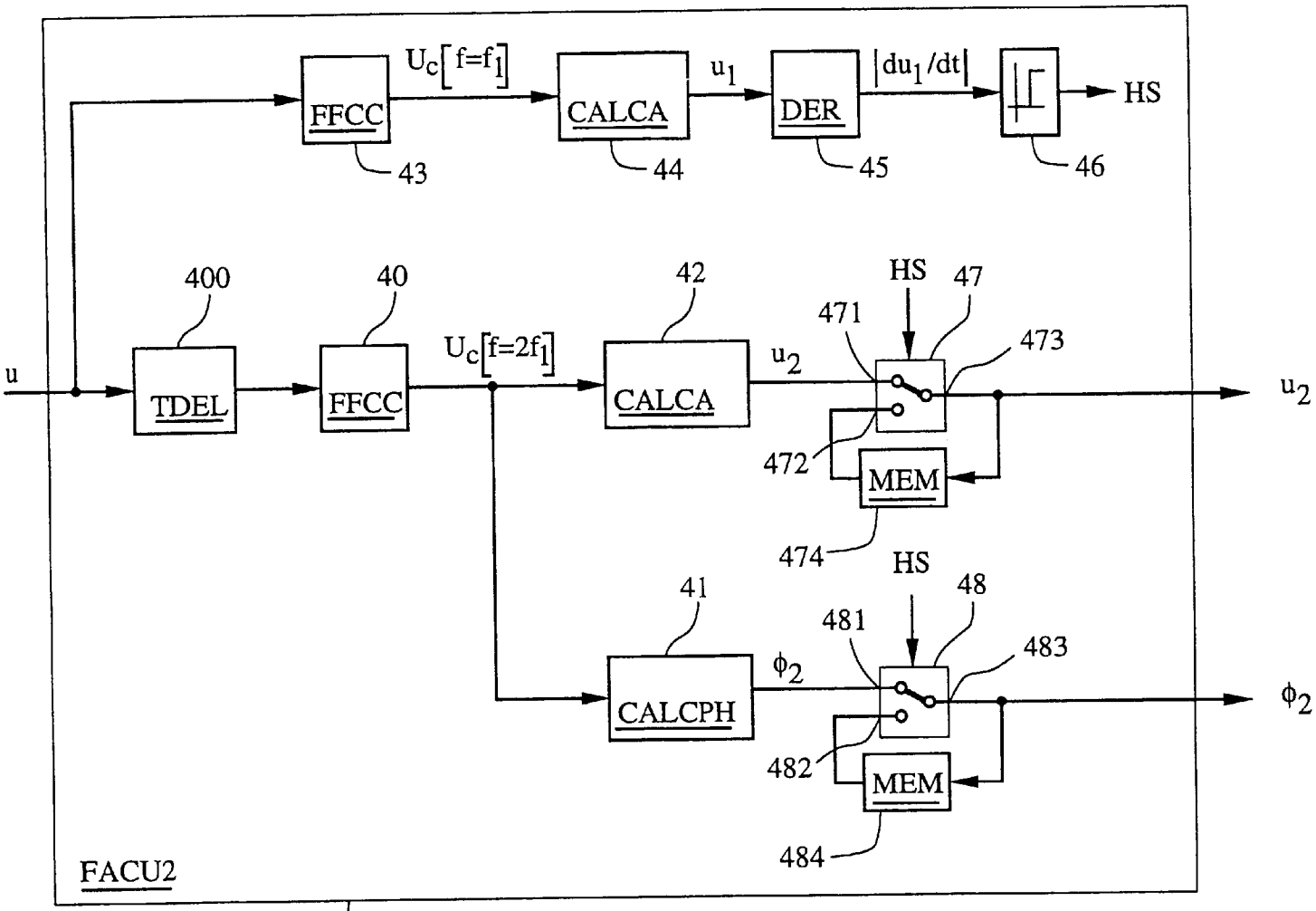
FIG. 4 shows an additional embodiment of a frequency-analyzing sub-unit in control equipment according to FIG. 2.

An advantageous embodiment of the frequency-analyzing sub-unit 212 is illustrated in FIG. 4. For determining both the amplitude value $u_2$ and the phase-angle value $\phi_2$, the actual-value sequence u[k] of discrete actual values is supplied to a complete-cycle Fourier filter 40 of a kind which is, in principle, the same as the Fourier filter described above for determining the phase angle $\phi_1$ for the fundamental component of the frequency $f_1$. The filter forms as output signal for a selecting frequency $f=2f_1$ a sum $U_c[f=2f_1]$, for example according to expression (10). The sum $U_c[f=2f_1]$ is supplied to a calculating unit 42, which forms therefrom, as output signal, the amplitude value $u_2$ from expression (8), as well as a calculating unit 41, which forms therefrom, as output signal, the phase angle $\phi_2$ from expression (9).

The frequency-analyzing sub-units 213, 214 and 215 may advantageously have the same fundamental composition as the sub-unit 212.

Frequency Adaptation—Embodiment 2

In a power network where frequency variations within a tolerance block wider than ±1 Hz may be expected, the sampling frequency $f_s = 1/Ts$, where Ts is the time between each sampling occasion mentioned above in connection with expression (2), may, in an advantageous embodiment, be varied in dependence on the actual value $f_1^*$ of the fundamental frequency.

The parameters of the Fourier filters included in the signal-analyzing unit SAU are assumed to be chosen such that the filters operate with selecting frequencies f which are equal to and constitute, respectively, integer multiples of the system frequency $f_1$ of the power network, and, without an active frequency adaptation, with a sampling time Ts0 corresponding to the system frequency.

The method according to this embodiment of the invention implies, in principle, that the sampling time is influenced in dependence on the actual value $f_1^*$ of the fundamental component in such a way that the actual value Ts of the sampling time becomes equal to the product of the sampling time Ts0 corresponding to the system frequency and of a quotient of the system frequency $f_1$ and the actual value $f_1^*$ of the fundamental frequency, i.e.

$$Ts = Ts0 * f_1, f_1^* \tag{17}$$

Since in practice the sampling time may generally be influenced only in such a way that it is eligible in a number of predetermined steps, it is chosen among the eligible predetermined sampling times so as to correspond as closely as possible to the product according to expression (17). This embodiment of the frequency adaptation is illustrated schematically in FIG. 2, by a block 29, which is supplied with the actual value $f_1^*$ of the fundamental frequency and, in dependence thereon, in some manner known per se, in correspondence with the method described above, forms a value of the sampling time Ts between each sampling occasion and supplies this value to the signal-analyzing unit SAU.

In this embodiment of the invention, the selecting frequencies of the respective Fourier filters may thus be equal to the system frequency and to multiples thereof, respectively, and nor is any adaptation of the parameters of the band stop filter according to embodiment 1 required.

Frequency Adaptation—Embodiment 3

Figure 5:
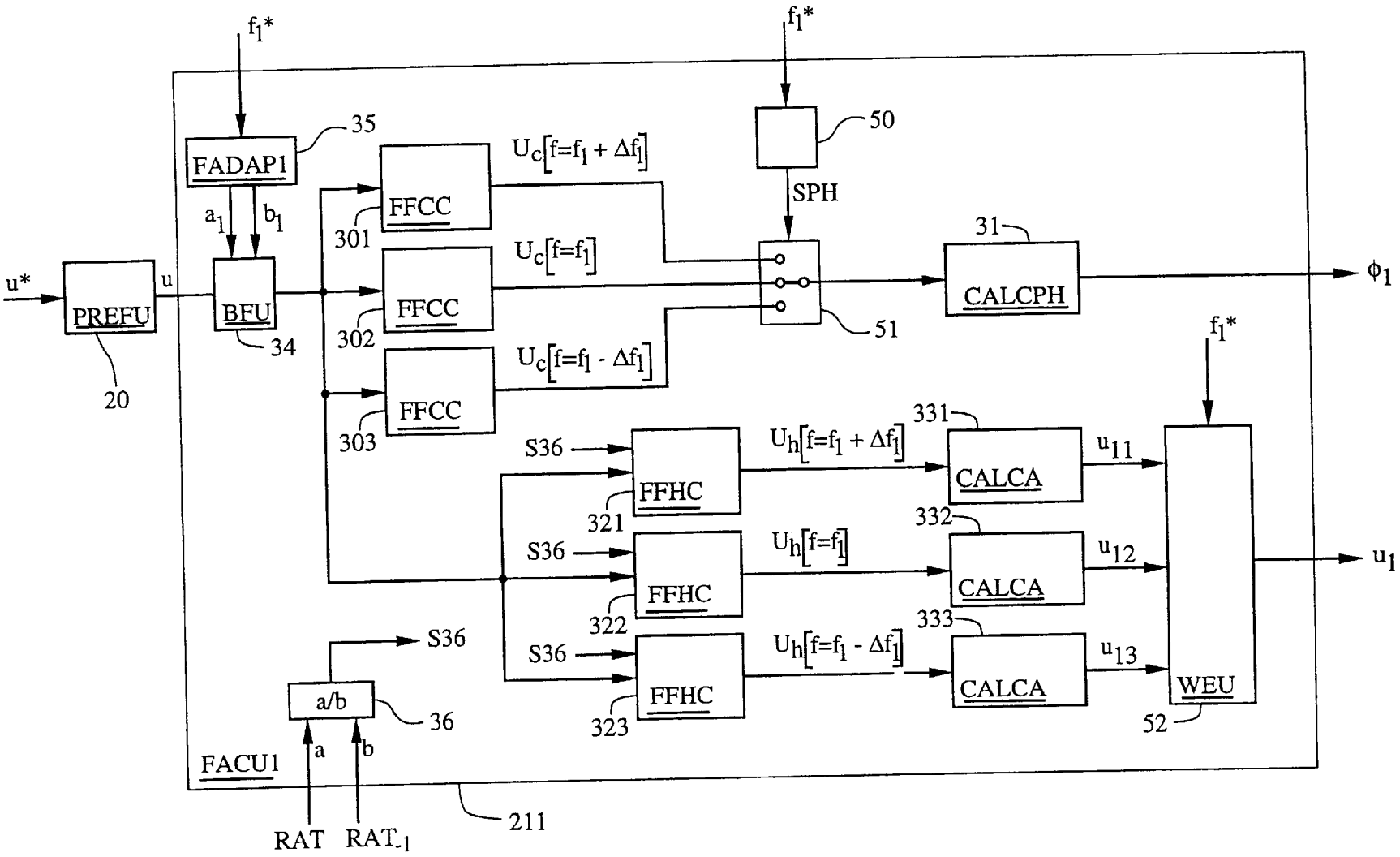
FIG. 5 shows an embodiment for frequency adaptation of a frequency-selecting sub-unit in control equipment according to FIG. 2.

Another embodiment of a frequency adaptation is illustrated schematically in FIG. 5. The figure shows an embodiment of the frequency-analyzing sub-unit 211, in appropriate parts of the same kind as that described with reference to FIG. 3.

For determining the phase angle $\phi_1$, the sequence u[k] of discrete actual values is supplied, in this embodiment, to three complete-cycle Fourier filters 301, 302, 303, respectively, which are each of the same kind as the Fourier filter 30 which was described above with reference to FIG. 3, but with the difference that the filter 301 is adapted to determine the sum $U_c[f]$ for a selecting frequency $f=f_1+\Delta f_1$, the filter 303 for a selecting frequency $f=f_1-\Delta f_1$, and the filter 302 for a frequency $f=f_1$, that is, the system frequency. The frequency addition $\Delta f_1$ is chosen with knowledge of frequency deviations occurring in the power network; for example, $\Delta f_1=1$ Hz may be chosen. Each one of the filters forms a sum $U_c[f]$ according to expression (10) in such a way that the filter 301 forms a sum $U_c[f=f_1+\Delta f_1]$, the filter 302 forms a sum $U_c[f=f_1]$, and the filter 303 forms a sum $U_c[f=f_1-\Delta f_1]$. Each one of these sums is supplied to a separate input of a selector member 51, which, in dependence on a selector signal SPH, forwards one of these sums to a calculating unit 31, which forms therefrom, as output signal, the phase angle $\phi_1$ from expression (9). The selector signal SPH is formed in some manner known per se in a selector unit 50, which in dependence on a supplied value of the actual value $f_1^*$ of the fundamental frequency, forms the selector signal such that the sum $U_c[f]$ whose frequency lies nearest the actual fundamental frequency is forwarded to the calculating unit 31.

For determining the amplitude $u_1$, the sequence u[k] of discrete actual values is supplied, in this embodiment, to three half-cycle Fourier filters 321, 322, 323, respectively, each of which being of the same kind as the Fourier filter 32 which is described above with reference to FIG. 3, but with the difference that the filter 321 is adapted to determine the sum $u_c[f]$ for a selecting frequency $f=f_1+\Delta f_1$, the filter 323 for a selecting frequency $f=f_1-\Delta f_1$, and the filter 322 for a selecting frequency $f=f_1$, that is, the system frequency. Each one of the filters forms a sum $U_h[f]$ according to expression (9) in such a way that the filter 321 forms a sum $U_h[f=f_1+\Delta f_1]$, the filter 322 forms a sum $U_h[f=f_1]$, and the filter 323 forms a sum $U_h[f=f_1-\Delta f_1]$. Each one of these sums is supplied to a separate calculating unit 331, 332, 333, respectively, each of which forms an amplitude value from expression (8), in the figure designated $u_{11}$, $u_{12}$, $u_{13}$, respectively. Each of these amplitude values is supplied to a weighting member 52, which in some manner known per se, in dependence on a supplied value of the actual value $f_1^*$ of the fundamental frequency, forms the amplitude value $u_1$ by weighing together the three amplitude values $u_{11}$, $u_{12}$, $u_{13}$ with weights corresponding to how close to the actual fundamental frequency the frequency, from which the amplitude values are determined, lies. The sums formed by the Fourier filters constitute pairs of quantities which represent amplitude and phase angle for components of the secondary voltage with predetermined frequencies, whereas the output signals from the respective weighting member 52 and the calculating member 31 constitute a pair of quantities which represent amplitude and phase angle for a component of the secondary voltage with a frequency equal to the fundamental frequency.

In this embodiment of the frequency adaptation, the frequency-analyzing sub-units 212–215 are designed in a manner similar to that described above for sub-unit 211, at least for determining the phase angles $\phi_2 \ldots \phi_5$, but advantageously also for determining the amplitude values $u_2 \ldots u_5$.

Frequency Adaptation—Embodiment 4

Figure 6:
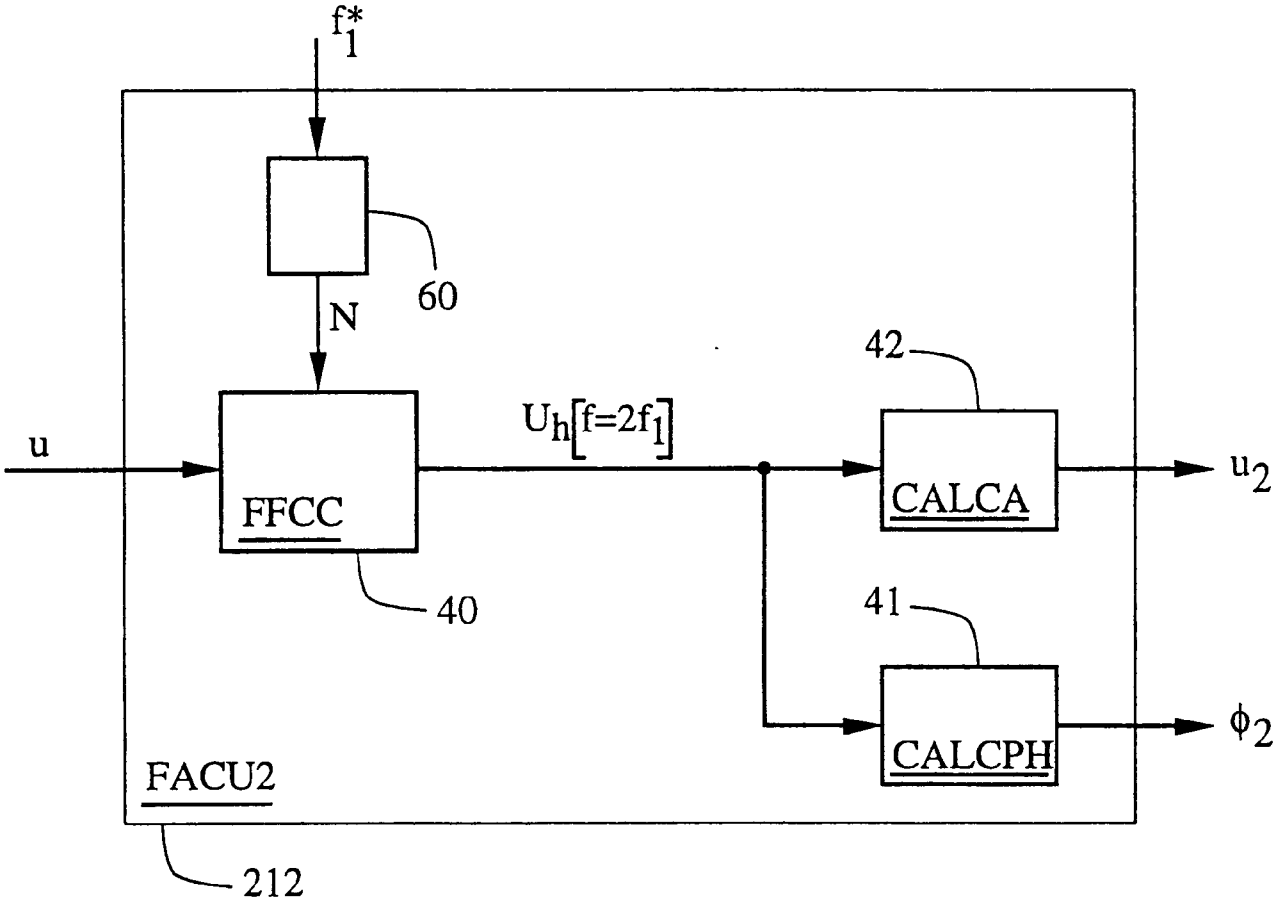
FIG. 6 shows another embodiment for frequency adaptation of a frequency-selecting sub-unit in control equipment according to FIG. 2.

Another embodiment of a frequency adaptation is illustrated schematically in FIG. 6. The figure shows an embodiment of the frequency-analyzing sub-unit 212, in applicable parts of the same kind as that described with reference to FIG. 4, but where, for the sake of simplicity, of the embodiment described there only the complete-cycle Fourier filter 40 and the calculating units 41 and 42 are shown in FIG. 6. The method according to this embodiment implies, in principle, that, at a predetermined sampling frequency, the number of samples N which are used for calculating the sums U[f] and $U_h[f]$, respectively, are determined such that the number becomes an integer over a period of the frequency of the frequency component in question. This is illustrated schematically in FIG. 6 in that a calculating unit 60, which is supplied with a value of the actual value $f_1$* of the fundamental frequency, in dependence thereon in some manner known per se, for example from a table stored in the calculating unit, determines the number N such that the above-mentioned condition is fulfilled. When calculating the sum U[f] based on expression (3) and the sum $U_k$[f] according to expression (10), respectively, a predetermined number of samples N is utilized, whereby a relationship of the following form should apply between the sampling frequency, the actual value of the the fundamental frequency and the number of samples:

$$f_s/f_1^*=N \tag{18}$$

From a practical point of view, the number of samples in dependence on the actual fundamental frequency of the power network is influenced such that the product of the number of samples and the actual fundamental frequency of the power network forms that number which lies closest to the predetermined sampling frequency, determined according to expression (18). A value of the number thus determined is supplied to the Fourier filter 40 to be used during the calculation, in this embodiment, of the sum $U_c[f=2f_1]$. It may be noted that, in this process, a relatively high sampling frequency is required, of the order of magnitude of 100 times the system frequency, in order for the process to provide a good accuracy, in that one of two adjacent integers should always be chosen, which, at the sampling frequency in question, are to correspond as closely as possible to one cycle of the frequency of the frequency component in question.

In this embodiment of the frequency adaptation, all the frequency-analyzing sub-units are designed in a manner similar to that of the sub-unit 212 described above.

Improvements of the Invention

It has been found that the ability of the control equipment to rapidly react to changes in the secondary voltage of the transformer may be improved by forming, in sub-unit 211, the amplitude value $u_1$ in dependence on a quotient between the transformer ratio RAT immediately after the latest sample in the actual-value sequence and its ratio $RAT_{-1}$ immediately prior to this sample.

FIG. 3 illustrates an advantageous embodiment of the frequency-analyzing unit 211 in this improvement of the invention. Values of the two transformation ratios mentioned, calculated in some manner known per se with knowledge of the number of turns in the primary and secondary windings of the transformer and of the actual tap-changer position, are supplied to a quotient generator 36, the output signal S36 of which is supplied to the Fourier filter 32. As described above, this is a half-cycle filter which forms the sum of $U_h$[f] based on expression (3), that is, without utilizing the recursive method according to expression (10). In some manner known per se, not shown in detail in the figure, all the values in the actual-value sequence u[k] which are utilized for calculating the sum $U_h$[f] are multiplied by the above-mentioned quotient.

It has also been found that great and rapid changes in the amplitude $u_1$ for the fundamental component may lead to disturbances in the function when determining the amplitude and phase position $\phi_2$, $\phi_3$, $\phi_4$, $\phi_5$ . . . of the harmonics $U_2$, $U_3$, $U_4$, $U_5$ . . . during the the 1–1.5 cycles of the fundamental frequency which follow immediately after such a change. The frequency-analyzing sub-unit 212 therefore comprises an additional complete-cycle Fourier filter 43 (FIG. 4) for determining the amplitude $u_1$ of the fundamental component. The filter forms as output signal a sum $U_c[f=f_1]$ according to expression (10) for a selecting frequency equal to the system frequency, which sum is supplied to a calculating unit 44, which forms therefrom, as output signal, the amplitude $u_1$ from expression (8). This output signal is supplied to a differentiating unit 45 adapted to determine, from a number of consecutive determinations of the value of the amplitude $u_1$, the absolute value $|d(u_1)/dt|$ of the time rate of change of this amplitude. The value of this absolute value is supplied to a level-sensing member 46 which, if the absolute value exceeds a predetermined value, forms a holding signal HS which locks the calculated values of the amplitude $u_2$ and the phase angle $\phi_2$ to the latest calculated values. This is illustrated in FIG. 4 in that the holding signal activates two selector members 47 and 48, respectively. The values of the amplitude $u_2$ and the phase angle $\phi_2$, formed by the respective calculating units 42 and 41 are supplied to inputs 471 and 481 of the respective selector members and are forwarded, when the selector members are in a passive position, continuously to the signal-synthetizing unit SSU via the outputs 473 and 483, respectively, of the selector members. The values of these outputs are supplied continuously to memory members 474 and 484, respectively, in which the latest of the respective values is continuously stored and supplied to inputs 472 and 482 of the respective selector members. When the selector members are activated by the holding signal, a switching takes place such that the signal-synthetizing unit SSU is supplied with the values stored in the memory members instead of with the values of the amplitude $u_2$ and of the phase angle $\phi_2$ which are continuously formed by the calculating units 41 and 42.

A delay member 400 delays the sequence u[k] before it is supplied to the Fourier filter 40 for determining the sum $U_c[f=2f_1]$. Typically, the level-sensing member 46 may form the holding signal HS if the value of the absolute value of the time rate of change for the amplitude $u_1$ corresponds to a change of the amplitude of the secondary voltage of 2.5% between two samples in the actual-value sequence and the time delay in the delay member 400 then correspond to 0.25 cycles of the fundamental tone.

In the embodiment described above, the control equipment is adapted to control the peak value of the secondary voltage of the transformer device to a given reference value. In certain contexts, however, it is desirable also to control the rms value of this voltage.

In an advantageous improvement of the invention, the signal-synthetizing unit SSU is also adapted to determine, from the values of the amplitudes and phase angles of the respective control components, an rms value signal EEV (FIGS. 2 and 7), which constitutes a measure of the rms value of the secondary voltage of the transformer device, taking into consideration components of this voltage as described above with reference to the description of the peak-value signal. As will be described below, in dependence on a preselected criterion, the rms value signal EEV may, at least temporarily, constitute a control quantity for the control equipment.

The rms value signal is supplied to a quotient generator 222 which is comprised in the deviation-forming unit DGU and which forms, as output signal, the quotient DEV between a reference value EVR for the rms value of the secondary voltage and the rms value signal, which quotient is supplied to a second input 232 of the selector member 23.

The selector member changes position in dependence on a switching signal CEV, formed in dependence on on a predetermined criterion, schematically illustrated in the figure by a block 25, such that either of the mentioned quotients DPV and DEV is supplied to the multiplier 24. The criterion may, for example, be formed in dependence on a comparison between the rms value signal and the peak-value signal (adapted for correct level comparison), or, alternatively, in dependence on a comparison between the respective deviations between the control quantities and their reference value. The transitions between control on peak value and rms value may also be made time-dependent. The switching signal CEV may also be formed in dependence on a control mode order CMO initiated from a superordinate control system or by an operator.

With the amplituds and the phase angles for the control components of the voltage variable known, the rms value a signal EEV may be calculated, in some manner known per se, based on the general expression $$EEV = \sqrt{\frac{1}{T}\int_0^T u_E^2\, dt},$$

whereby the rms value signal is continuously calculated by means of the integral transformed into a sum.

Typical Values of the Parameters of the Fourier Filters

For the control equipment and the Fourier filters comprised therein, the following parameters may be typically chosen, at a system frequency of 50 Hz.

The sampling time between each sample Ts=0.001 seconds (in case of a frequency adaptation according to embodiment 4, however, the sampling time should be chosen to be of the order of magnitude of Ts=0.0002 seconds and the number of samples per cycle of the fundamental frequency of the order of magnitude of N=100 to provide satisfactory accuracy).

For the half-cycle filter 32 in the frequency-analyzing sub-unit 211 (the selecting frequency equal to the system frequency), p=1, N=10, which gives the filter stop frequencies $f_b$=150, 250, 350, . . . Hz and a settling time $\tau$=10 ms.

For the complete-cycle filter 30 in the frequency-analyzing sub-unit 211 (the selecting frequency equal to the system frequency), p=2, N=20, which gives the filter stop frequencies $f_b$=100, 150, 200, . . . Hz and a settling time $\tau$=20 ms.

For the complete-cycle filter 40 in the frequency-analyzing sub-unit 212 (the selecting frequency equal to twice the system frequency), p=4, and for the complete-cycle filters in the respective sub-unit 213 (the selecting frequency equal to three times the system frequency), p=6, in the sub-unit 214 (the selecting frequency equal to four times the system frequency), p=8, and in the sub-unit 215 (the selecting frequency equal to five times the system frequency), p=10, which gives the filters a settling time $\tau$=20 ms. For all of these filters, N=20 is chosen.

At a system frequency of 60 Hz, the sampling frequency is suitably increased from typically f=1 kHz to typically f =1.2 kHz.

Performance Requirements, Advantages

In tap-changers of so-called static type, the switching operations are executed by means of controllable semiconductor valves, for example thyristors. Such a tap-changer permits switching of the tap-changer position each time the current through the control windings of the transformer passes through zero. To make use of this possibility, control equipment for the transformer device, after a change of the sensed voltage, should give a correcting control signal half a cycle of the fundamental frequency thereafter (180 electrical degrees or, at 50 Hz system frequency after 10 ms and at 60 Hz 8.4 ms, respectively). This makes it possible for the change of the sensed voltage to be restored within one cycle of the fundamental frequency.

In a power network, voltage variations are usually for the most part related to the fundamental component of the voltage whereas harmonics and other disturbances usually originate from equipment connected to the power network. It is therefore primarily important that the control equipment rapidly provides the correct control signal in dependence on a change of the amplitude of the fundamental component of the sensed voltage.

As is clear from the above, control equipment, designed as described above, permits a very rapid cancellation, especially of changes in the amplitude of the fundamental component of the sensed voltage, but also of changes of harmonics to this component, and the control signal may be calculated consecutively on each sampling occasion. Although the control equipment is applicable to control also of conventional tap-changers, it is thus especially advantageous for control of tap-changers of static type.

Since the above-mentioned fundamental frequency generally does not fully correspond to the system frequency of the power network, by adaptation of the control signal in dependence on the actual fundamental frequency of the power network, according to the invention, an improved accuracy in the control is achieved in relation to the prior art, and a use of the control equipment also in power networks with great frequency variations is made possible.

The embodiments of the invention described above, and the improvements thereof, relate to a single-phase transformer. It is to be understood that, in polyphase transformers, such control equipment may be used for each one of the phases.

The invention is not limited to the embodiments shown but a plurality of modifications are feasible as it is defined by the claims.

Thus, the first control component of the voltage variable need not necessarily be formed as a component with a frequency corresponding to the selecting frequency.

For example, the half-cycle filter in the sub-unit 211 described above may also be formed as a complete-cycle filter and the calculating algorithms for the Fourier filters may be based on expression (3) as well as on the recursive method described.

The described embodiments of the frequency adaptation may either be applied separately or be combined in a manner which should be clear to the person skilled in the art on the basis of the above description. Thus, for example, the above-described embodiment 4 of the frequency adaptation may be applied to a frequency-analyzing sub-unit 211. In that context, also the above-described embodiment 1 of the frequency adaptation should be implemented in the sub-unit 211 (as well as when the embodiment 3 of the frequency adaptation is applied to a frequency-analyzing sub-unit 211.

What is claim is:

1. A method for controlling a secondary voltage (US) in a transformer device connected to a power network with a given system frequency ($f_1$), said transformer device comprising a tap-changer (TC) which, in dependence on a supplied control signal (RCS), influences the voltage ratio (RAT) of the transformer device, whereby a voltage variable ($u_E$) is formed in dependence on the secondary voltage, which voltage variable comprises at least one first control component ($u_1$, $\phi_1$) which represents a fundamental frequency component of the secondary voltage, a control quantity (EPV, EEV) is formed in dependence on the voltage variable, and, in dependence on a deviation (DPV, DEV) between the control quantity and a given reference value (PVR, EVR) therefor, the control signal is formed and supplied to the tap-changer, characterized in that the actual fundamental frequency ($f_1$*) of the power network is continuously sensed and that the voltage variable is formed in dependence thereon.

2. A method according to claim 1, wherein an actual-value sequence (u[k]) of discrete actual voltage values is formed in dependence on the secondary voltage and the voltage variable is formed in dependence on the actual-value sequence, characterized in that, in the the actual-value sequence, at least some frequency component representing an even integer multiple of the actual fundamental frequency of the power network is blocked.

3. A method according to any of claims 1, wherein an actual-value sequence of discrete actual voltage values is formed in dependence on the secondary voltage by sampling with a sampling time (Ts) which may be influenced in a number of steps and the voltage variable is formed in dependence on the actual-value sequence by means of at least one Fourier filter (30, 32, 301–303, 321–323) for selecting the first control component, characterized in that the sampling time is influenced in dependence on the actual fundamental frequency of the power network such that its actual value as closely as possible will correspond to a product of a sampling time (Ts0) corresponding to the system frequency and of a quotient of the system frequency and the actual value of the fundamental frequency.

4. A method according to claim 2, wherein an actual-value sequence of discrete actual voltage values is formed in dependence on the secondary voltage, characterized in that the voltage variable is formed in dependence on the actual-value sequence by means of Fourier filters (30, 32, 301–303, 321–323) for selecting at least the first control component, said Fourier filters forming pairs of quantities representing amplitude and phase angle for components of the secondary voltage with predetermined frequencies, a first pair ($u_{11}$, $\phi_{11}$) of quantities for a first frequency ($f_1+\Delta f_1$) equal to the system frequency plus a predetermined frequency addition ($\Delta f_1$), a second pair ($u_{12}$, $\phi_{12}$) of quantities for a frequency equal to the system frequency, a third pair ($u_{13}$, $\phi_{13}$) of quantities for a second frequency ($f_1-\Delta f_1$) equal to the system frequency minus a predetermined frequency addition, and in that a fourth pair ($u_1$, $\phi_1$) of quantities, representing amplitude and phase angle for the first control component, is formed in dependence on said first, second and third pairs of quantities and on the actual fundamental frequency of the power network.

5. A method according to claim 2, wherein an actual-value sequence of discrete actual voltage values is formed in dependence on the secondary voltage by sampling with a predetermined sampling frequency ($f_s$) and the voltage variable is formed in dependence on the actual-value sequence by means of a Fourier filter (40) for selecting and forming the first control component by means of a number (N) of samples from the actual-value sequence, which number may be influenced in a number of steps, characterized in that the number of samples for selecting the first control component is influenced in dependence on the actual fundamental frequency of the power network such that the product of the number of samples and the actual fundamental frequency of the power network forms the number which lies closest to the predetermined sampling frequency.

6. A method according to claim 1, characterized in that the voltage variable, in addition thereto, comprises at least one second control component ($u_2$, $\phi_2$) representing a harmonic component of the secondary voltage.

7. A method according to claim 6, wherein, for each of the first and second control components of the voltage variable, an amplitude value ($u_1$, $u_2$, respectively) and a phase-angle value ($\phi 1$, $\phi 2$, respectively) are formed, characterized in that a time rate of change ($du_1/dt$) of the amplitude value for the first control component of the voltage variable is formed and that, when the absolute value ($|du_1/dt|$) of said time rate of change exceeds a predetermined value, the amplitude value and the phase-angle value for the second control component of the voltage variable are each maintained at the values they had immediately before said absolute value exceeded said predetermined value.

8. A method according to claim 1, characterized in that a peak value (EPV) for the voltage variable is formed and that the control quantity is formed in dependence on a peak value.

9. A method according to claim 1, characterized in that a root mean square value (EEV) for the voltage variable is formed and that the control quantity is formed in dependence on a root mean square value.

10. A method according to claim 1, wherein an actual-value sequence of discrete actual voltage values is formed in dependence on the secondary voltage and the voltage variable is formed in dependence on the actual-value sequence by means of a Fourier filter (30, 40, 43, 301–303, 321–323) for selecting the first control component by means of a predetermined number of samples from the actual-value sequence, and with which Fourier filter there is formed a sum ($U_k$[f]) representing at least a phase-angle value ($\phi_1$) for the first control component, characterized in that this sum is determined by a recursive method according to the expression $$U_k[f]=U_{k-1}[f]-u[k-N]*e^{-j\omega(k-N)Ts}+u[k]*e^{-j\omega kTs},$$

where $U_k$[f] designates the sum determined from the last N consecutive values in the actual-value sequence u[k], and $U_{k-1}$[f] designates the sum determined from those N consecutive values in the actual-value sequence which are displaced one sampling occasion earlier than those which are used for determining the sum $U_k$[f], f designates the selecting frequency $\omega=2\pi f$ of the Fourier filter, Ts designates the time between two consecutive values in the actual-value sequence, k is a running integer index and N designates the predetermined number of samples.

11. A method according to claim 1, wherein an actual-value sequence of discrete actual voltage values is formed in dependence on the secondary voltage and the voltage variable is formed in dependence on the actual-value sequence by means of a Fourier filter for selecting and forming the first control component by means of a predetermined number of samples from the actual-value sequence, characterized in that each of the samples (u[k]) which are utilized by the Fourier filter for selecting the first control component is multiplied by a quotient ($RAT/RAT_{-1}$) of the ratio of the transformer device immediately after (RAT) and its ratio immediately before ($RAT_{-1}$) the last sample in the actual-value sequence.

12. A device (TCC) for controlling a secondary voltage (US) in a transformer device connected to a power network with a given system frequency ($f_1$), said transformer device comprising a tap-changer (TC) which, in dependence on a supplied control signal (RCS), influences the voltage ratio (RAT) of the transformer device, said device comprising means (20, SAU, SSU) for forming, in dependence on a supplied value of the secondary voltage, a voltage variable ($u_E$) in dependence on the secondary voltage, said voltage variable comprising at least one first control component ($u_1$, $\phi_1$) representing a fundamental frequency component of the secondary voltage, means (SSU) for forming a control quantity (EPV, EEV) in dependence on the voltage variable, and means (DGU) for forming the control signal in dependence on a deviation (DPV, DEV) between the control quantity and a given reference value (PVR, EVR) therefor, characterized in that said means form the voltage variable in dependence on a continuously supplied value of the actual fundamental frequency ($f_1$*) of the power network.

13. A device according to claim 12, with means for forming an actual-value sequence (u[k]) of discrete actual voltage values in dependence on the secondary voltage and for forming the voltage variable in dependence on the actual-value sequence, characterized in that it comprises means for blocking, in the actual-value sequence, at least some frequency component, which represents an even integer multiple of the actual fundamental frequency of the power network, in dependence on the actual fundamental frequency of the power network.

14. A device according to claim 12, characterized in that it comprises means for forming an actual-value sequence of discrete actual voltage values, by sampling with a sampling time (Ts) which may be influenced in a number of steps, at least one Fourier filter (30, 32, 301–303, 321–323) for selecting the first control component, and means (29) for influencing the sampling time in dependence on the actual fundamental frequency of the power network such that its actual value as closely as possible will correspond to a product of a sampling time (Ts0), corresponding to the system frequency, and of a quotient of the system frequency and the actual value of the fundamental frequency.

15. A device according to claim 13, with means for forming, by sampling, an actual-value sequence of discrete actual voltage values in dependence on the secondary voltage, characterized in that it comprises Fourier filters (30, 32, 301–303, 321–323) for selecting at least the first control component, said Fourier filters forming pairs of quantities representing amplitude and phase angle for components of the secondary voltage with predetermined frequencies, a first pair ($u_{11}\phi_{11}$) of quantities for a first frequency ($f_1+\Delta f_1$) equal to the system frequency plus a predetermined frequency addition ($\Delta f_1$), a second pair ($u_{12}$, $\phi_{12}$) of quantities for a frequency equal to the system frequency, and a third pair ($u_{13}$, $\phi_{13}$) of quantities for a second frequency ($f_1-\Delta f_1$) equal to the system frequency minus a predetermined frequency addition, as well as means (50, 51, 31, 52) for forming a fourth pair ($u_1$, $\phi_1$) of quantities representing amplitude and phase angle for the first control component in dependence on said first, second and third pairs of quantities and on the actual fundamental frequency of the power network.

16. A device according to claim 13, with means for forming, by sampling with a predetermined sampling frequency ($f_s$), an actual-value sequence of discrete actual voltage values in dependence on the secondary voltage, characterized in that it comprises at least one Fourier filter (40) for selecting and forming the first control component by means of a number (N) of samples from the actual-value sequence, which number may be influenced in a number of steps, and means (60) for influencing the number of samples for selecting the first control component such that the product of the number of samples and the actual fundamental frequency of the power network forms the number which is closest to the predetermined sampling frequency.

17. A device according to claim 12, characterized in that it comprises means for forming the voltage variable to comprise at least one second control component ($u_2$, $\phi_2$) representing a harmonic component of the secondary voltage.

18. A device according to claim 17, characterized in that it comprises means (211, 212, 43, 44) for forming an amplitude value ($u_1$, $u_2$, respectively) and a phase-angle value ($\phi_1$, $\phi_2$, respectively) for each one of the first and second control components of the voltage variable, means (45) for forming an absolute value ($|du_1/dt|$) of the time rate of change of the amplitude value for the first control component of the voltage variable, means (46) for comparing said absolute value with a predetermined value, and means (47, 474, 48, 484) for maintaining each of the amplitude value and the phase-angle value for the second control component of the voltage variable at the values they had immediately before said absolute value exceeded said predetermined value, when said absolute value exceeds said predetermined value.

19. A device according to claim 12, characterized in that it comprises means (77) for forming a peak value (EPV) for the voltage variable and means (DGU) for forming the control quantity in dependence on said peak value.

20. A device according to claim 12, characterized in that it comprises means (78) for forming a root mean square value (EEV) for the voltage variable and means (DGU) for forming the control quantity in dependence on said root mean square value.

21. A device according to claim 12, with means for forming, by sampling, an actual-value sequence of discrete actual voltage values in dependence on the secondary voltage, whereby the voltage variable is formed in dependence on the actual-value sequence, characterized in that it comprises at least one Fourier filter (30, 40, 43, 301–303, 321–323) for selecting the first control component by means of a predetermined number of samples from the actual-value sequence, said Fourier filter forming a sum ($U_k$[f]) representing at least one phase-angle value ($\phi_1$) for the first control component, whereby said sum is determined by a recursive method according to the expression $$U_k[f]=U_{k-1}[f]-u[k-N]*e^{-j\omega(k-N)Ts}+u[k]*e^{-j\omega kTs},$$

where $U_k$[f] designates the sum determined from the last N consecutive values in the actual-value sequence u[k], and $U_{k-}$[f] designates the sum determined from those N consecutive values in the actual-value sequence which are displaced one sampling occasion earlier than those which are used for determining the sum $U_k$[f], f designates the selecting frequency $\omega=2\pi f$ of the Fourier filter, Ts designates the time between two consecutive values in the actual-value sequence, k is a running integer index, and N designates the predetermined number of samples.

22. A device according to claim 12, with means for forming, by sampling, an actual-value sequence of discrete actual voltage values in dependence on the secondary voltage, characterized in that it comprises a Fourier filter (32, 321–323) for selecting and forming the first control component in dependence on the actual-value sequence, and in which Fourier filter a predetermined number of samples from the actual-value sequence are utilized for selecting the first control component, as well as means (36, 32, 321–323) for multiplying each of the samples (u[k]) which are utilized by the Fourier filter for selecting the first control component by a quotient ($RAT/RAT_{-1}$) of supplied values of the ratio of the transformer device immediately after (RAT) and its ratio immediately before ($RAT_{-1}$) the last sample in the actual-value sequence.

* * * * *